United States Patent [19]

Hawke

[11] Patent Number: 4,774,860

[45] Date of Patent: Oct. 4, 1988

[54] TONG AND BELT APPARATUS FOR A TONG

[75] Inventor: Melvin C. Hawke, Katy, Tex.

[73] Assignee: Weatherford U.S., Inc., Houston, Tex.

[21] Appl. No.: 910,886

[22] Filed: Sep. 24, 1986

[51] Int. Cl.[4] ..... B25B 21/00

[52] U.S. Cl. ..... 81/57.17; 81/57.14; 81/57.38

[58] Field of Search ..... 81/57, 57.11, 57.14, 81/57.15, 57.17, 57.33, 57.38, 57.4, 57.42, 57.43

[56] References Cited

U.S. PATENT DOCUMENTS

| | | | |
|---|---|---|---|
| 1,422,302 | 7/1922 | Parker | 81/57.33 |
| 1,481,157 | 1/1924 | Smith | 81/57.17 |
| 1,702,822 | 2/1929 | Ferguson | 81/57.15 |
| 2,509,688 | 5/1950 | Loosli | 81/57 |
| 2,650,070 | 8/1953 | Lundeen | 255/35 |
| 2,879,680 | 3/1959 | Beeman et al. | 81/53 |
| 3,481,228 | 12/1969 | Dickmann et al. | 81/57 |
| 3,799,010 | 3/1974 | Guier | 81/57 |
| 3,892,140 | 7/1975 | Fox et al. | 74/224 |
| 3,906,820 | 9/1975 | Hauk | 81/57.17 |
| 4,079,640 | 3/1978 | Golden | 81/57.17 |
| 4,084,453 | 4/1978 | Eckel | 81/57.18 |
| 4,099,429 | 7/1978 | Hauk | 81/57.17 |
| 4,167,128 | 9/1979 | Chandler et al. | 81/66 |
| 4,212,212 | 7/1980 | Chandler et al. | 81/57.17 |
| 4,346,629 | 8/1982 | Kinzbach | 81/57.2 |
| 4,471,674 | 9/1984 | Doss | 81/57.17 |
| 4,512,216 | 4/1985 | Callegari, Sr. et al. | 81/57.17 |
| 4,604,922 | 8/1986 | Soutsos | 81/57.17 |

FOREIGN PATENT DOCUMENTS

| | | | |
|---|---|---|---|
| 480401 | 1/1952 | Canada | 81/57.17 |
| 175902 | 10/1965 | U.S.S.R. | 81/57.17 |
| 457593 | 3/1975 | U.S.S.R. | 81/57.33 |
| 489626 | 10/1975 | U.S.S.R. | 81/57.33 |

*Primary Examiner*—Robert P. Olszewski
*Assistant Examiner*—William E. Terrell
*Attorney, Agent, or Firm*—Vaden, Eickenroht, Thompson & Boulware

[57] ABSTRACT

A tong having a non-endless or an endless flexible belt. A belt assembly for mounting, disposing, and moving a flexible belt in a tong or in the rotary of tongs having rotary elements. Such a tong for rotating a tubular member according to the present invention has a housing; a rotary element in the housing which is either turned manually or power driven; mount plates (which can also serve as brake plates) disposed within the housing and movable therein with respect to the rotary element and, upon the action of other member, movable with the rotary element; an anchor assembly mounted to the mount plates; a belt carrier mounted to the rotary element; a flexible belt extending from the anchor assembly to the belt carrier, the belt being tightened around the tubular as the rotary and belt carrier rotate to the point where a portion of the belt is wrapped around the tubular and the belt carrier has moved to contact the anchor assembly and stop up against it or in a recess in the anchor assembly, at which point the anchor assembly and mount plates become stationary with respect to the rotary and move with it.

17 Claims, 16 Drawing Sheets

FIGURE I

TONG AND BELT APPARATUS FOR A TONG

BACKGROUND OF THE INVENTION

1. Field of the Invention

This invention relates to belt apparatus useful for rotating or turning an object and particularly to the field of tongs employing such a belt apparatus, both manually operated and power-driven tongs, of the type commonly used for making up and breaking apart threaded connections between tubular members and the like, and to processes for using such a belt apparatus or such a tong.

2. Description of the Prior Art

Jaw and Die Tongs

Present day tongs that are employed for coupling and decoupling threaded pipe sections are typically subject to one or more of a number of practical problems. Some examples are found in systems for the engagement and disengagement of sections of a casing or pipe string that is to be lowered into or removed from a well bore. Extremely high torques may have to be applied, due to combinations of factors such as the presence of corrosion, the existence of distortion, and pipe size and weight. High shock forces arise, both in the "make" direction of rotation when a shoulder is suddenly encountered, and in the "break" direction at initial engagement of the tong and disengagement of the threads. Moreover, the forces and pressures involved are at such levels that operation is seldom smooth and uniform. For example, with a power-driven tong, in excess of 50,000 foot-pounds of torque may be exerted, while relatively small die elements engage the pipe with extremely high force loadings. Consequently, it is common for slippage to occur, for the pipe surfaces to become marred or otherwise damaged.

Tubular members must be successively joined and lowered into the well or, conversely, separated and removed therefrom. Joint sections generally are circular, and the tubulars have no provision for keyed type engagement with a tong mechanism.

Grip elements, such as jaws with dies, can be provided with multiple serrations, or penetration features, to provide the interference contact needed at the joint surface. The progressive refinement of tubular materials and installation procedures and use practices has mandated limitation and control of grip element penetrations into the joint surfce. Consequently, the distribution and balance of grip element energizing forces are critical factors in the design, development and evaluation of such tong mechanisms.

Various mechanisms involving linkages, levers, wedges, and cams are in current use for the disposition and balance of the force components. Usually, grip elements, or dies, are arcuately disposed within carrier bodies, or jaws, which span a circumferential segment of the joint surface. A degree of compromise must be established to accommodate acceptable ranges of joint and mechanism dimensional tolerance.

Design compromises, common to the art, structure jaws to operate with very high load variations between leading and trailing dies, or resort to jaw guiding slides, or linkages, to control die contact and force delivery. However, all jaw guides absorb energy and detract from torque delivery. Also, extremely uneven die loading causes excessive marring or damage to the tubular surface.

The examples of prior art constructions mentioned also are susceptible to one or more of a variety of other problems. For example, fragments and dirt can enter into the cam devices that are typically used to urge the jaws or dies into engagement with the pipe, damaging the cams and causing the dies to lock in or out of position or dirt deposited in serrations in dies can inhibit proper die action, prevent proper penetration into the tubular to be rotated, and result in deleterious scarring of pipe.

Many designs also are such that die loading becomes increasingly asymmetrical as pipe size is reduced, substantially increasing die wear and the probability of damage. A power tong should preferably be able to cover a range of pipe sizes without difficulty, and if a further pipe size change is needed it should be effected with only an interchange of parts. Maintenance and life problems have an economic significance far in excess of the cost of the dies or even the pipe involved, because the down time that results when replacements or repair must be made involves not only material costs but also drilling rig and crew costs and the continuing charges for other specialized tools and equipment present at the drilling rig. Thus a power tong system which requires frequent replacement of dies or other elements or which causes undue damage to sections in a pipe string would be far inferior to a power tong system which operates steadily and uniformly.

The extremely high stresses and abrupt shocks encountered in a tong operation are usually attended by visible strains on the equipment and by vibrations and sharp impacts which results in a very short fatigue life for the parts involved and the unit as a whole. These are caused by overload or unbalanced force conditions which are further evidenced by undue wear, slippage or equipment damage.

Some tongs use drag or braking techniques to secure proper biting of the dies relative to the pipe. As the rotary is driven the head or other member supporting the dies is frictionally restrained to insure that the dies do not simply rotate with the rotary. In many power tong systems, a substantial part of the available energy is effectively used only for overcoming braking friction.

Belt and Chain Tongs

Instead of using jaws or dies to grip pipe, many tongs use an endless belt, chain or flexible material loop. Such tongs are disclosed in U.S. Pat. Nos. 3,799,010; 3,906,820; 3,892,140; 4,079,640; 4,099,479; and 4,212,212. Many problems are encountered with the use of such tongs.

(1) The length of an endless chain must be changed to accommodate tubulars of different size or means must be provided to maintain tubulars on a centered position. If the tubular is not maintained in the desired centered position, torque monitoring is difficult or impossible.

(2) Multiple link chains employ links which, because of their shape, can slip at high torques.

(3) The high load needed to rotate a tubular to acceptable torque levels can induce undesirable wear on moving parts.

(4) A tong using pivotable arms or gate members to hold a tubular within the tong body can be transformed into a dangerous projectile if the arms' activating or control mechanism fails allowing the tong to disengage from the tubular.

(5) High loads can crush relatively fragile tubulars.

(6) Slippage (which can cause galling and other damage to tubulars) will occur if the gripping element (belt, chain, etc.) loading mechanism cannot maintain an adequate preload force on the tubular.

Relatively Fragile Tubulars and Premium Tubulars

Both the jaw/die tongs and the belt/chain tongs described above can be used with (and are usually used with) relatively hard and rigid metal tubular such as casing and tubing. When such tongs are used with thick tubulars or tubulars made from relatively "softer" metals or from premium metals such as high alloy steels or low carbon steels or tubulars made from non-metal materials such as fiber glass, they often literally chew up the tubular. Manufacturers of such tubular have recommended against the use of any tong with dies or with hard contact means such as chains. On the other hand, the use of strap wrenches was recommended; but available strap wrenches are inadequate because of the inability to precisely control the torque applied with such wrenches—a problem which is compounded by the fatigue of users since the use of such wrenches requires considerable physical labor. Leaking and pollution may occur if a worker thinks a tight makeup has been achieved when in fact optimum torque has not yet been reached.

When working with fiber glass reinforced pipe, serrated or toothed dies (or jaws with such dies) can easily cause marking or damage to tubulars. Such damage results in destruction of reinforcing filaments in the tubular and can considerably reduce the tubular's strength. When the outside surfaces of the fiber glass pipe are irregular or outside diameters of individual joints vary, either inadequate or extreme die penetration is achieved.

SUMMARY OF THE INVENTION

The present invention is directed to a tong having a non-endless or an endless flexible belt and to a belt assembly for mounting, disposing and moving such a flexible belt in a tong or in the rotary of tongs having rotary elements. A tong for rotating a tubular member according to the present invention has a housing; a rotary element in the housing which is either turned manually or power driven; mount plates (which can also serve as brake plates) disposed within the housing and moveable therein with respect to the rotary element and, upon the action of other members, moveable with the rotary element; an anchor assembly mounted to the mount plates; a belt carrier mounted to the rotary element; a flexible belt extending from the anchor assembly to the belt carrier, the belt being tightened around the tubular as the rotary and belt carrier rotate to the point where a portion of the belt is wrapped around the tubular and the belt carrier has moved to contact the anchor assembly and stop up against it or in a recess in the anchor assembly, at which point the anchor assembly and mount plates become stationary with respect to the rotary and move with it. The tong may have a throat opening so that the tong can be moved from the side onto a tubular or it may have a closed-off housing with an opening therethrough so that the tong is emplaced over the end of the tubular to be worked and then positioned at the desired point about the tubular.

The flexible belt can be any suitable flexible material which will produce the necessary torque for the type and size of tubular being rotated, such as a belt made from metal, plastic, nylon, woven material, or aramid fiber material such as KEVLAR (Registered Trademark) material. If a non-endless belt is used, the belt's ends can both be secured to the anchor assembly with a loop or loops going around the belt carrier or one end of the belt can be secured to the anchor assembly and one end to the belt carrier.

To provide preloading, brake means can be provided to coact with the mount means to which the anchor assembly is mounted. The brake force must be overcome before the mount means can move. Before the braking force is overcome, there is enough force to wrap the belt around the tubular sufficiently quickly and tightly enough that slippage is reduced or prevented, then the belt has sufficient frictional contact with the pipe to begin to turn it. Appropriate moveable mounting of the belt carrier to the rotary element and use of a recess in the rotary element can provide a toggling-lever action which serves to enhance the tightening of the belt and the preloading action.

Easily accessible belt-tightening or adjusting members can be provided on the tong according to the present invention. To counteract the tendency of a tubular to be moved off-center by a tightening or tightened belt, an adjustable backup device, rest member, or flexible centering member (belt, chain, etc.) can be provided to accommodate tubulars of various sizes so that they are not pushed off-center by the action of the belt. In one embodiment two belt apparatuses according to the present invention can be used to provide centering and backup capabilities.

It is, therefore, an object of this invention to provide rotative device such as a tong with a flexible belt which can efficiently rotate a tubular member. It is also an object of the present invention to provide a belt assembly for such a device and processes for using it.

One particular object of the present invention is the provision of such a tong wherein the belt is non-endless and the provision of such a belt assembly in which the belt is non-endless.

Another object of the present invention is the provision of a tong with a flexible belt and structure for preloading so that the belt does not slip on a tubular to be rotated.

An additional object of the present invention is the provision of such a tong in which a portion of the belt is wrapped around a tubular to be rotated and held tightly enough so that sufficient torque is developed to rotate the tubular.

Yet another object of the present invention is the provision of such a tong in which a backup apparatus, rest member or centering means is provided to maintain a tubular centered in the tong.

A further object of the present invention is the provision of a tong utilizing a flexible belt which will not damage or deform tubulars made of relatively fragile, weak, or thin materials; for example, soft metals, premium alloys, composites, fibers, plastics or fiber glass.

A particular object of the present invention is to provide such a tong which has a belt made from woven nylon or aramid material such as KEVLAR (Registered Trademark).

Yet another object of the present invention is the provision of a tong which does not necessarily need jaws, dies, or chains.

Another object of the present invention is the provision of a tong having easily accessible and easily manipulable belt-tightening members.

A specific object of the present invention is the provision of guides for the tong belt which bring more of the belt into contact with a tubular to be rotated.

To one of skill in this art who has the benefit of this invention's teachings other and further advantages and objects will be clear from the description of preferred embodiments when taken in conjunction with the accompanying drawings.

BRIEF DESCRIPTION OF THE DRAWINGS

FIGS. 14*d*—14*m* shows parts of the tension link assembly of FIG. 14 *a;*

FIG. 14*d*, side view of the tension bar assembly;

FIG. 14*e*, top view of the tension stop member;

FIG. 14*g*, side view of the tension stop member of FIG. 14*f;*

FIG. 14*h*, top view of the pivot member;

FIG. 14*i*, cross-sectional view along line 14*i*—14*i* of FIG. 14*h* of the pivot member;

FIG. 14*j* is a cross-sectional view along line 14*j*—14*j* of FIG. 14*k* of the pivot member spacer;

FIG. 14*k* is a top view of the pivot member spacer of FIG. 14*j;*

FIG. 14*l* is a top view of a drive link; and

FIG. 14*m* is a side view of the drive link of FIG. 14*l*.

All Figures are drawn to scale.

DESCRIPTION OF PREFERRED EMBODIMENTS

Figure 1:
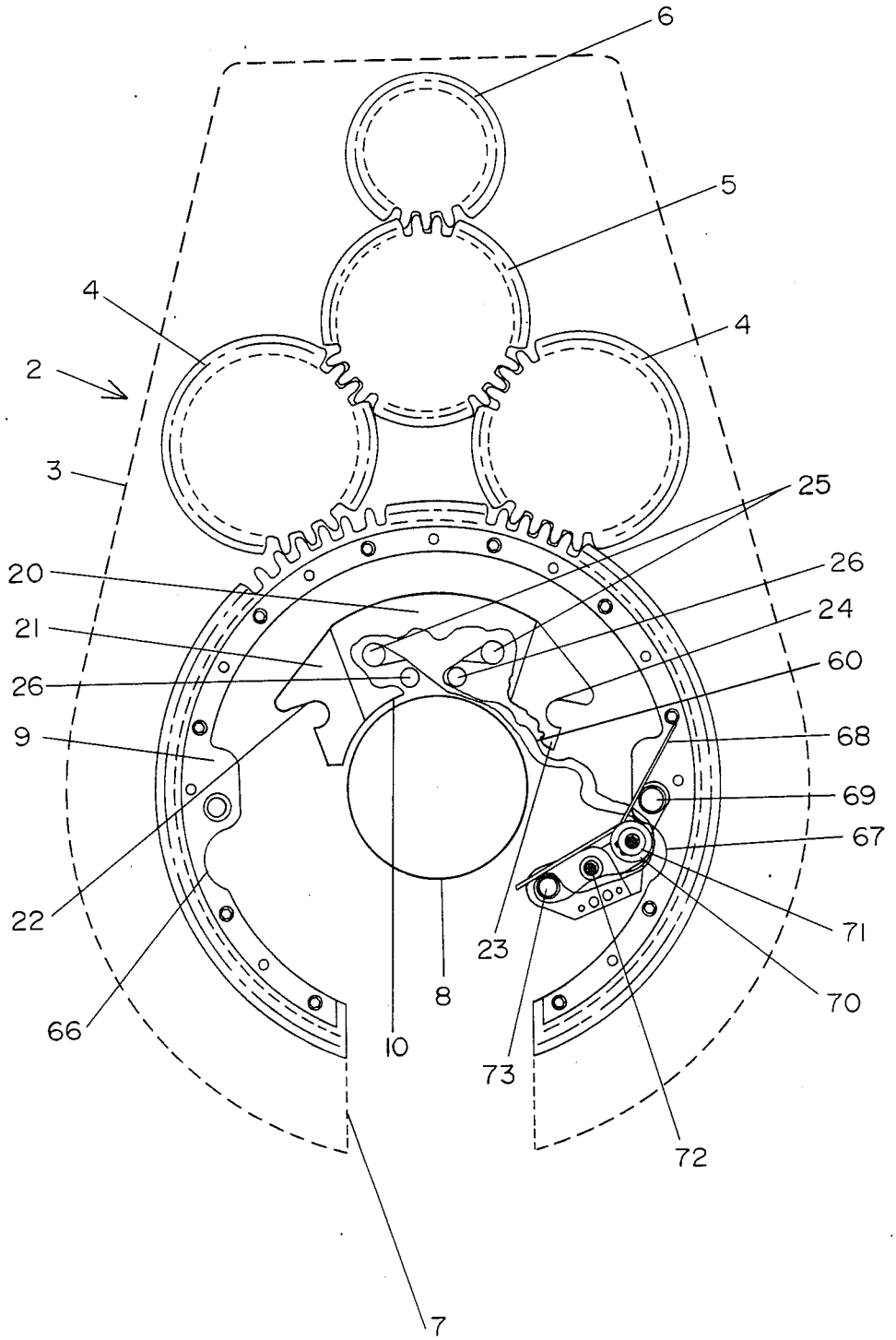
FIG. 1 is a top plan view of a tong according to the present invention about a pipe with the top mount plate removed and the tong case and drive gears shown in outline.

Referring now to FIG. 1, a tong 2 has a tong case 3 (shown in outline) and drive elements including idler gears 4, a drive gear 5, and a drive gear 6. A tong recess 7 in the case 3 is provided for receiving the tubular member to be rotated. A tubular pipe 8 (exterior surface only depicted in FIG. 1) is shown centered in the tong 2. The gears turn a rotary element 9 via their toothed engagement therewith.

A belt apparatus 10 including an anchor assembly 20, a belt 60, and a belt carrier assembly 70 is disposed within the tong 2. The belt apparatus 10 in combination with other tong parts provides the means for wrapping the belt 60 about the pipe 8 in a non-symmetrical configuration with respect to the longitudinal axis of the pipe and the corresponding axis of the tong 2.

The anchor assembly 20 has the top makeup pivot plate 21 with a makeup recess 22 for receiving a belt carrier pivot pin 73, and a top break-out pivot plate 23 with a break-out recess 24 for receiving the belt carrier pivot pin 73. The anchor assembly is bolted to the mount brake plates (not shown). The belt 60 has one end connected to one of anchor pins 25 and another end connected to another anchor pin 25. To increase the amount of the belt 60 in contact with the pipe 8, guide pins 26 are provided for positioning and directing the belt 60.

Figure 14A:
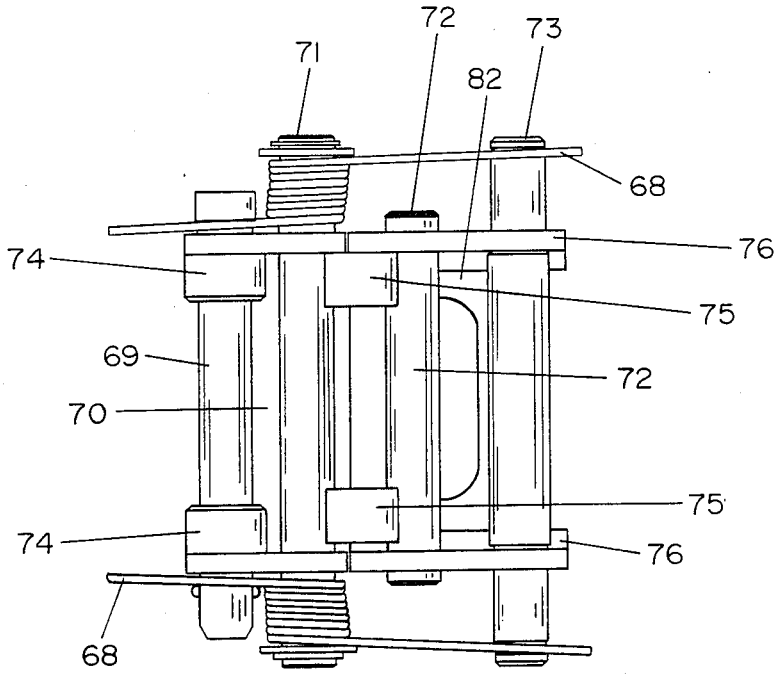
FIG. 14*a* is a side view of the belt carrier assembly in the position of the belt carrier assembly of FIG. 2.
Figure 14B:
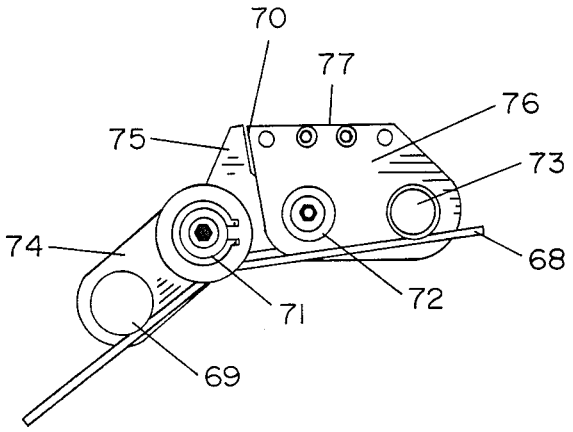
FIG. 14*b* is a top view of the belt carrier assembly of FIG. 14*a*.
Figure 14C:
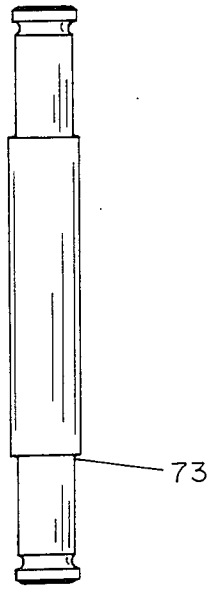
FIG. 14*c* is a side view of the anchor shaft of the belt carrier assembly of FIG. 14*a*.
Figure 14D:
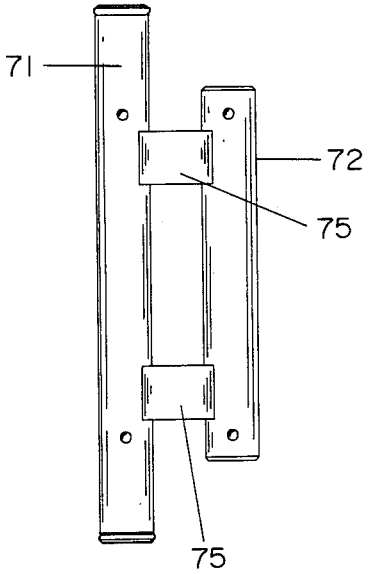
Figure 14E:
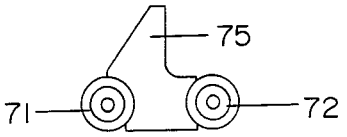
Figure 14F:
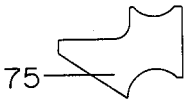
Figure 14G:
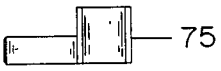
Figure 14H:
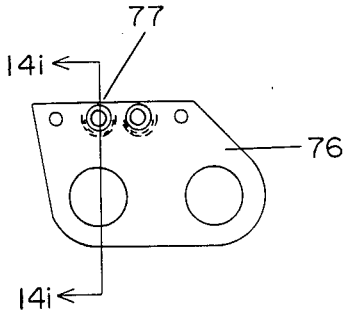
Figure 14J:
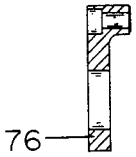
Figure 14J:
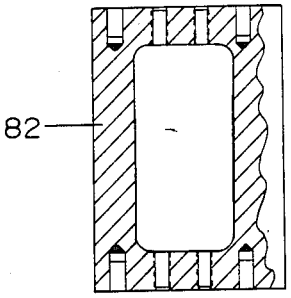
Figure 14K:
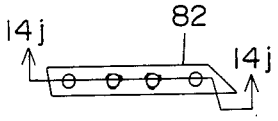
Figure 14L:
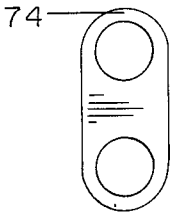
Figure 14M:
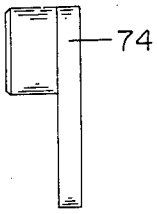

The belt 60 extends from the anchor assembly 20 to the belt carrier assembly 70 and is looped around the belt carrier pivot pin 73. The belt carrier assembly 70 is pivotably connected to the rotary element 9 by a drive pin 69 which extends through an opening in a drive link 74. The drive link 74 is pivotably connected to the remainder of the belt carrier assembly 70 by a tension bar shaft 71 which extends through a tension bar stop member 75 (FIG. 14*b*) and through the drive link 74. A pivot member 76 of the belt carrier assembly 70 has the belt carrier pivot pin 73 extending therethrough for holding a loop of the belt 60.

Figure 2:
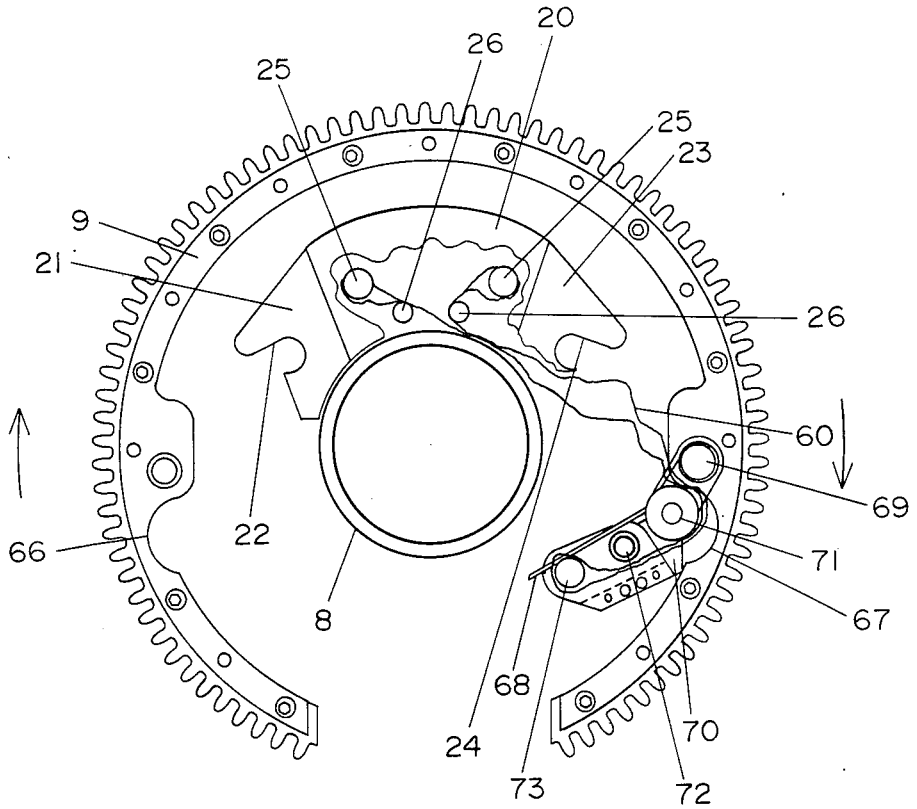
FIGS. 2–7 are top plan views showing the tong rotary and belt assembly of the present invention during various stages of rotation about a tubular.
Figure 3:
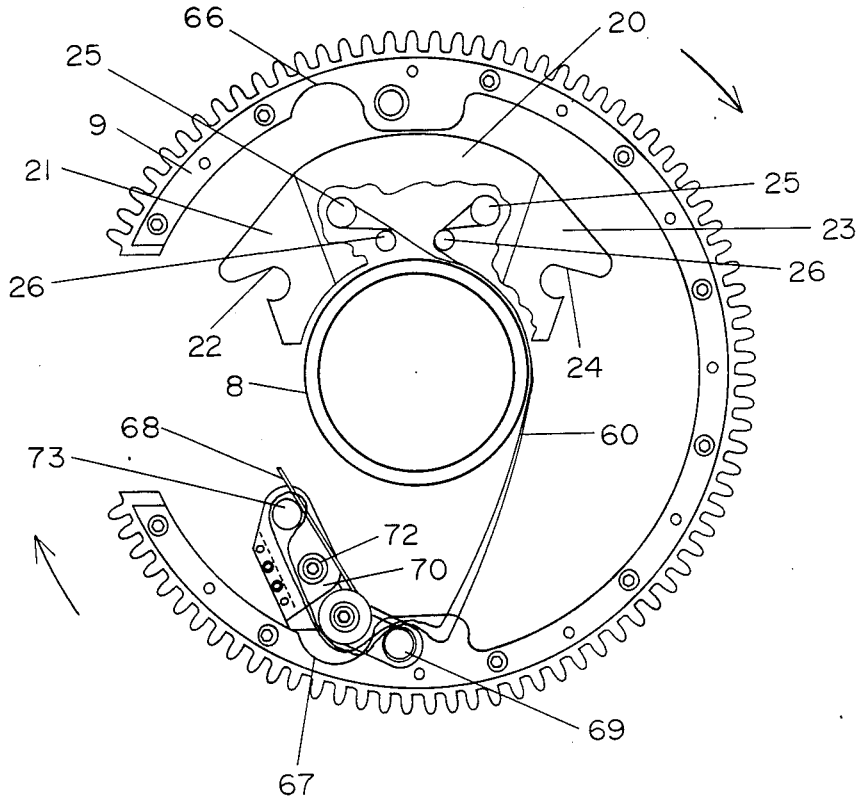

As shown in FIG. 1, the belt 60 is relatively loose and limp. This is also the situation depicted in FIG. 2 (which indicates the interior surface of the pipe 8). FIG. 3 illustrates the location of the belt after a slight clockwise rotation of the rotary element 9. The belt 60 has become taut and some of it is in contact with the exterior surface of the pipe 8. The anchor assembly has not yet moved.

Figure 4:
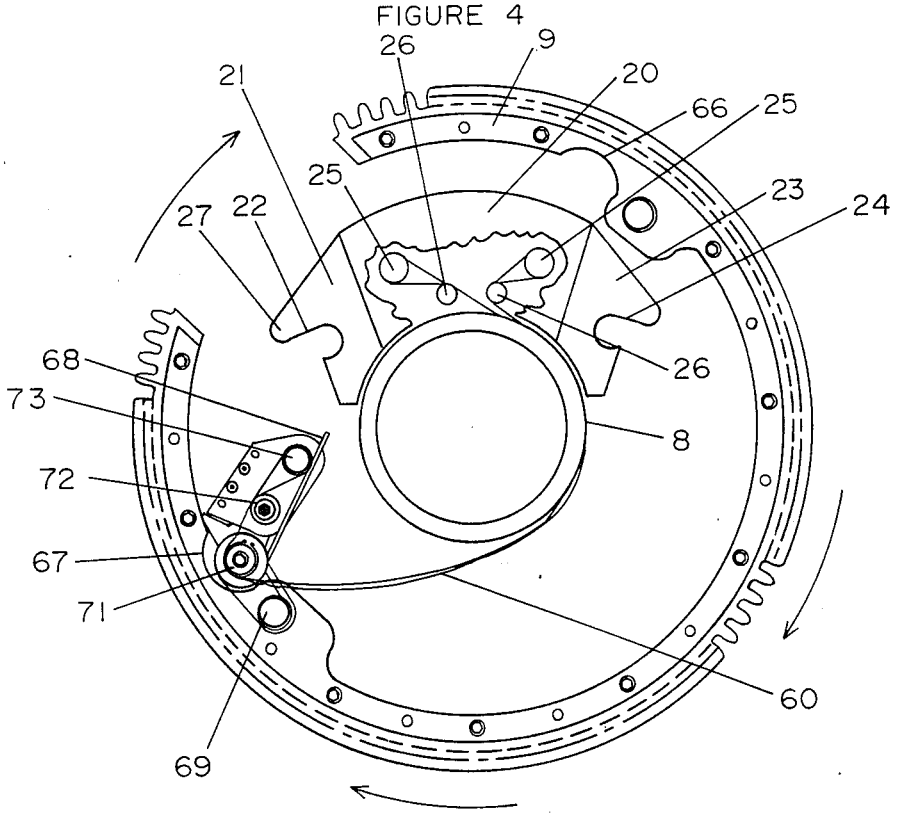

FIG. 4 illustrates the belt 60's configuration in response to further rotation of the rotary element 9.

Figure 5:
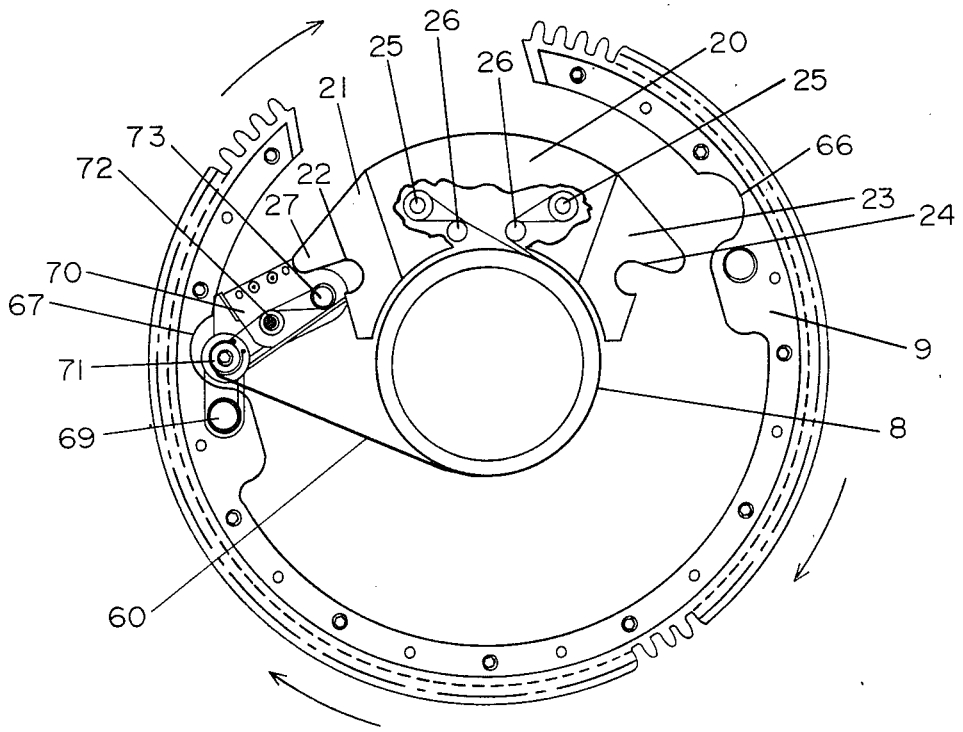

Referring now to FIG. 5, the rotary element 9 has moved further in a clockwise direction, the belt 60 is tighter and more of it is contacting the pipe 8. A finger 27 of the makeup plate 21 has been received within the belt carrier assembly 70 and the belt carrier pivot pin 73 is poised to enter the makeup recess 22 of the makeup plate 21. A return spring 68 prevents the belt carrier assembly from collapsing on itself.

Figure 6:
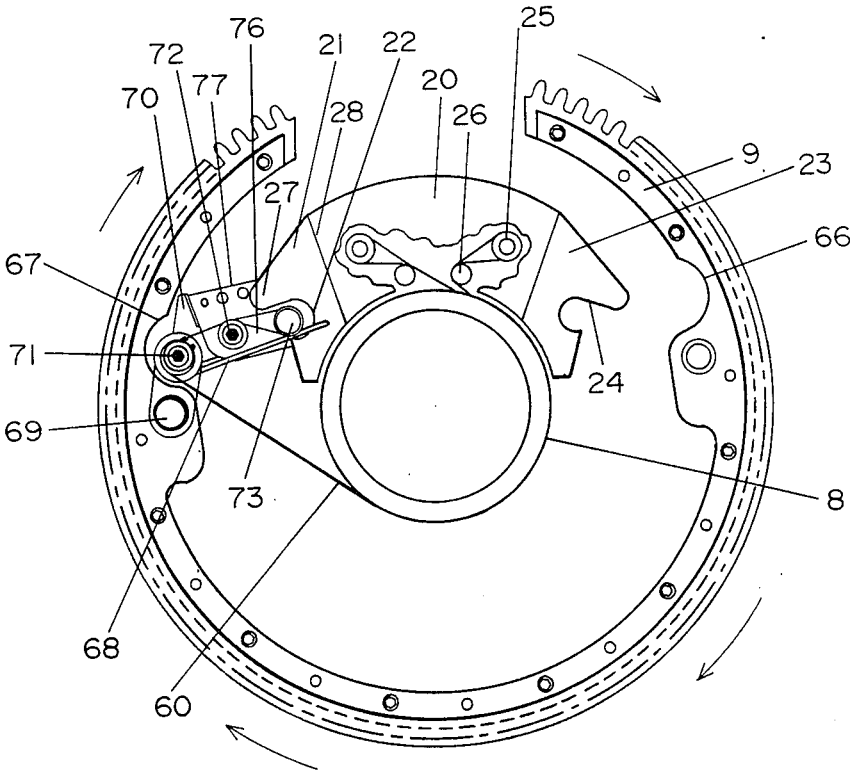

As shown in FIG. 6, upon further rotation of the rotary element 9 the belt carrier pivot pin 73 has entered the makeup recess 22 and the finger 27 has moved even farther into the belt carrier assembly.

Figure 7:
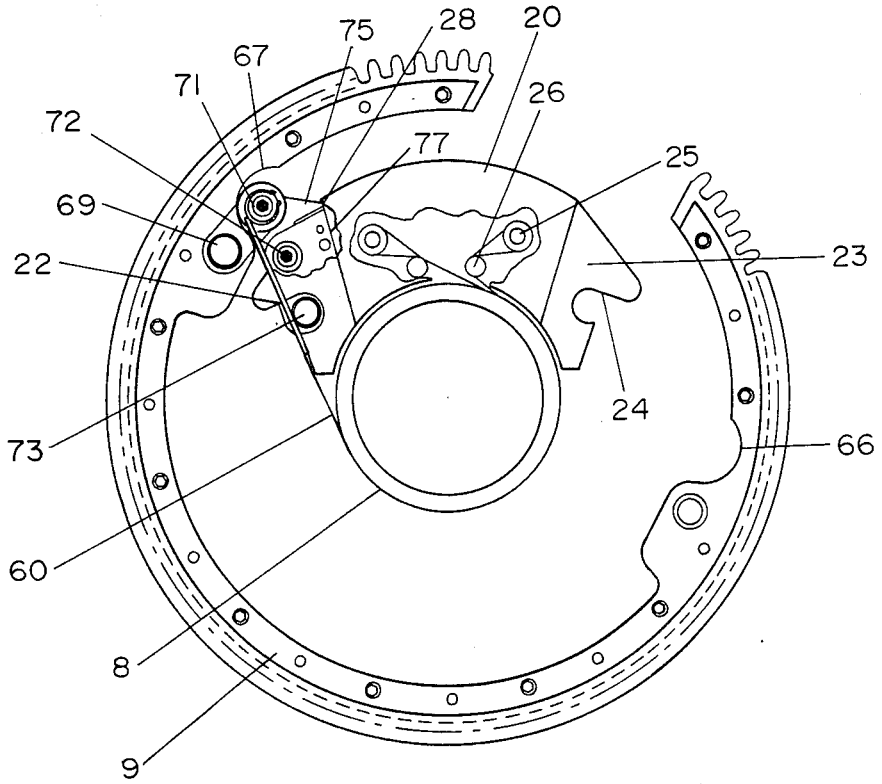

FIG. 7 illustrates further movement of the rotary element 9 resulting in pivotal movement of the tension bar stop member 75 about the tension bar shaft 71. The belt carrier pivot pin 73 has been fully received in and restrained by the makeup recess 22. The tension bar shaft 71 has moved further into the rotary recess 67. In a configuration in which the belt carrier assembly is mounted on the other side of the rotary element, the tension bar shaft 71 will move into the rotary recess 66. The stop surface 77 of the pivot member 76 has contacted and been stopped by the stop surface 28 of the back plate 37 (FIG. 15*e*) of the anchor assembly 20. The rotary element 9 cannot now move further unless it moves the belt carrier assembly 70 and the anchor assembly 20.

As will be described below, the anchor assembly is connected to mount plates which in turn are acted upon by braking apparatus. It is, this braking force which the rotary element 9 must overcome to move the anchor assembly 20. Once this force is overcome the rotary element 9, belt 60, belt carrier assembly 70, and anchor assembly 20 will move in unison and cause the pipe 8 to rotate. Prior to the overcoming of this braking force, and after the belt carrier pivot pin 73 has been restrained in the recess 22, the tension bar shaft 71 and the tension bar pin 72 continue to move in relation to the pivot member 76. This in turn lengthens the distance between the tension bar shaft 71 and the belt carrier pivot pin 73, thereby pulling or preloading the belt until the stop surfaces 28 and 77 as well as tension stop member 75 and stop surface 77 come into contact. This preloading assures that when the parts and assemblies move in unison there is already sufficient force so that the belt 60 will not slip on the pipe 8.

Figure 8:
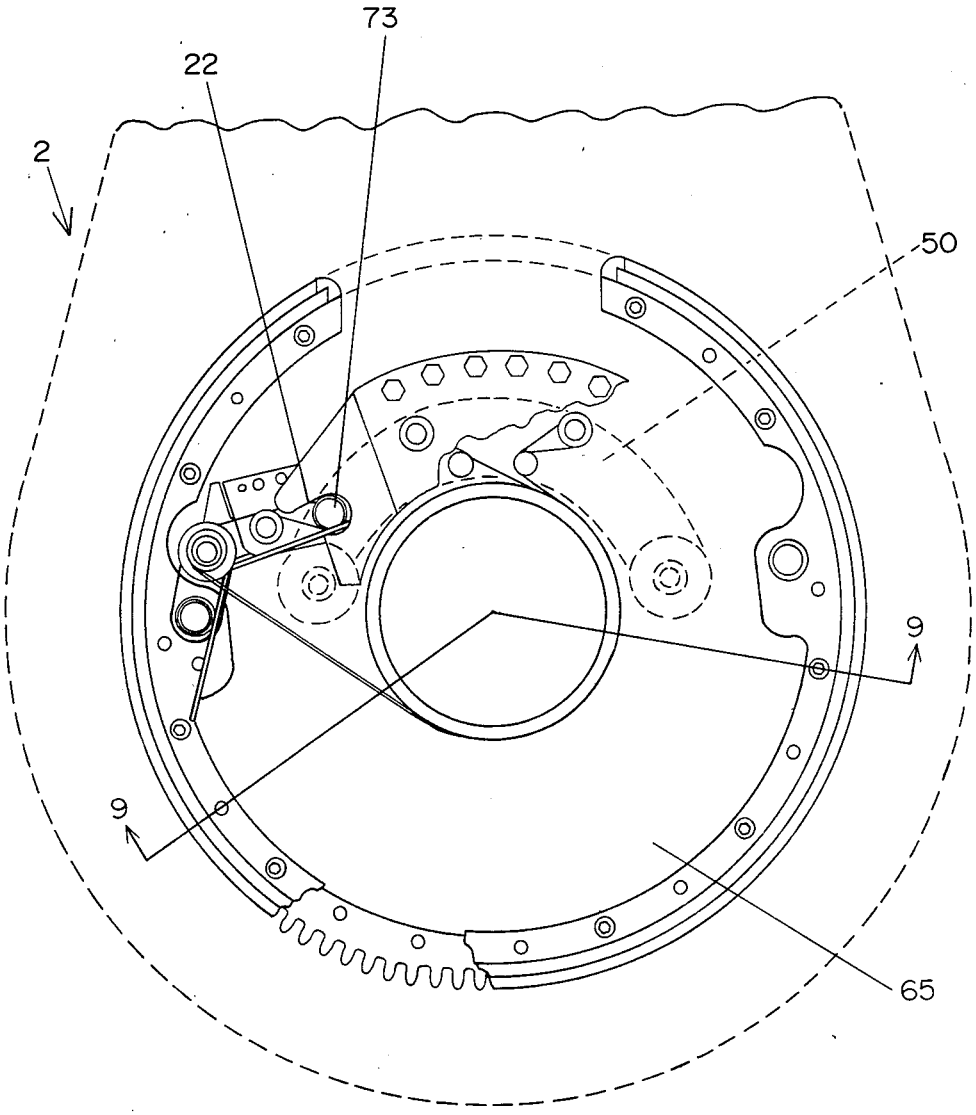
FIG. 8 is a top plan view of a tong rotary and belt assembly according to the present invention with the top mount plate and scissors backup shown in outline.

More detail of the tong 2 is illustrated in FIG. 8. In outline a mount brake plate 65 is shown and a backup device 50 is similarly shown. The rotary element 9 has rotated the belt carrier assembly in FIG. 8 to the point where the belt carrier pivot pin 73 has been received in and restrained by the makeup recess 22.

Figure 9:
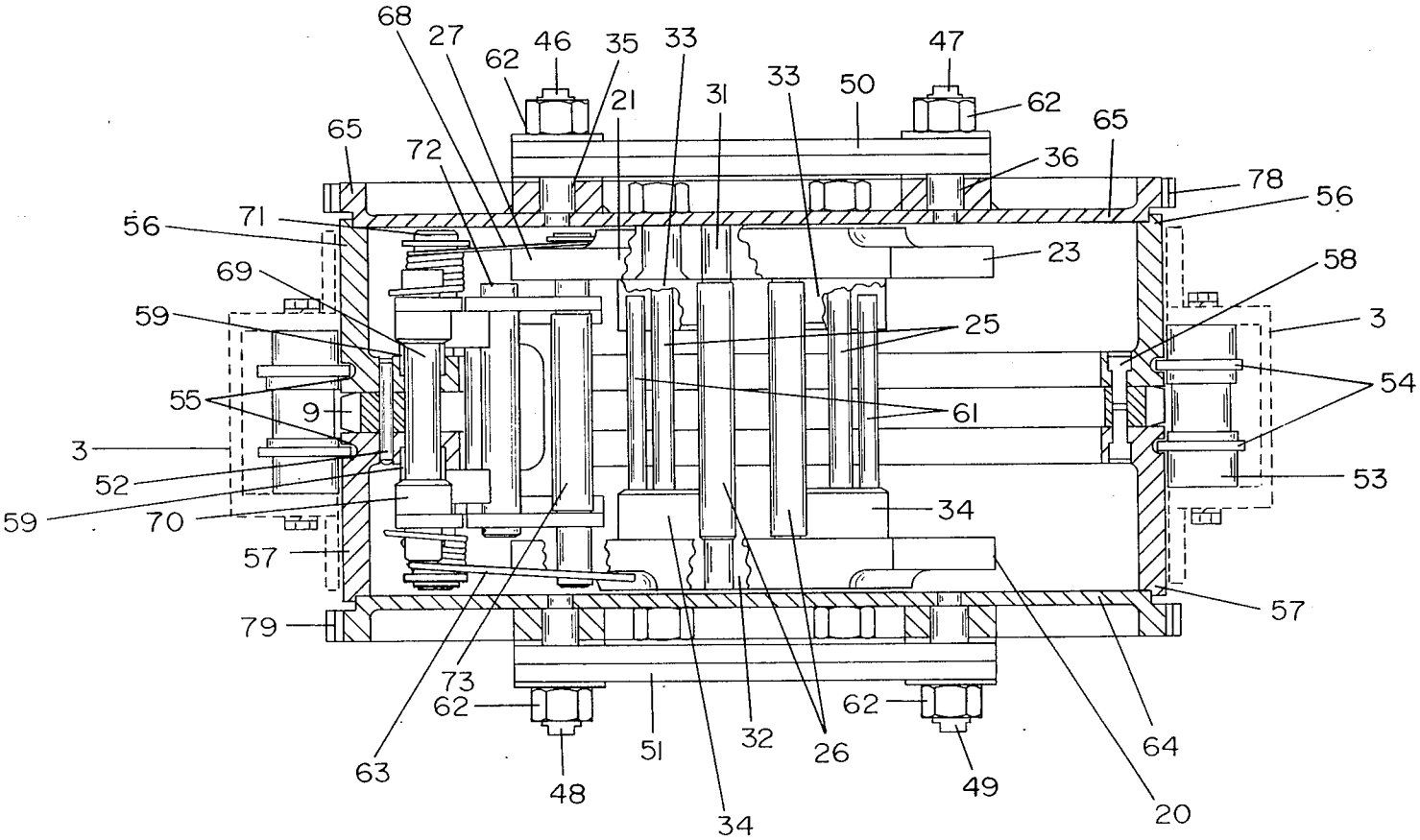
FIG. 9 is a side view taken along 9—9 of the rotary assembly, anchor assembly and belt carrier assembly of FIG. 8.

FIG. 9 presents a view of the apparatus of FIG. 8 along line 9—9 of FIG. 8 (without the belt). FIG. 9 illustrates the full anchor assembly 20 and belt carrier assembly 70 in relation to the tong case 3 and the rotary element 9. The anchor assembly 20 is bolted to the top mount brake plate 65 and to the bottom mount brake plate 64. The backup device 50 is bolted to the top of the top mount brake plate 65 and the backup device 51 is bolted to the top of the bottom mount brake plate 64. Braking action on the plates 64, 65 is provided by conventional braking means such as band brakes 79, 78, respectively.

Referring further to FIG. 9, a top rotary guide 56, rotary element 9, and bottom rotary guide 57 are bolted together by bolts such as bolt 58 and the pieces are positioned correctly by using locating pins such as pin 52. The mount brake plates 64, 65 move on the rotary guides and carry with them the anchor assembly 20. A top anchor assembly plate 31 (which is comprised of, inter alia, plates 21, 23) is bolted to the top mount brake plate 65. The bottom anchor assembly plate 32 is bolted to the bottom mount brake plate 64. The anchor pins 25, guide pins 26, and take up pins 61 extend between the plates 31, 32 (and their respective lugs 33, 34).

The relation of the belt carrier assembly 70 to the rotary element 9 and anchor assembly 20 is shown in FIG. 9. The drive pin 69 is mounted through bushings 59 in the rotary guides. The belt carrier pivot pin 73 is shown within the makeup recess 22 (see FIG. 8).

Figure 10A:
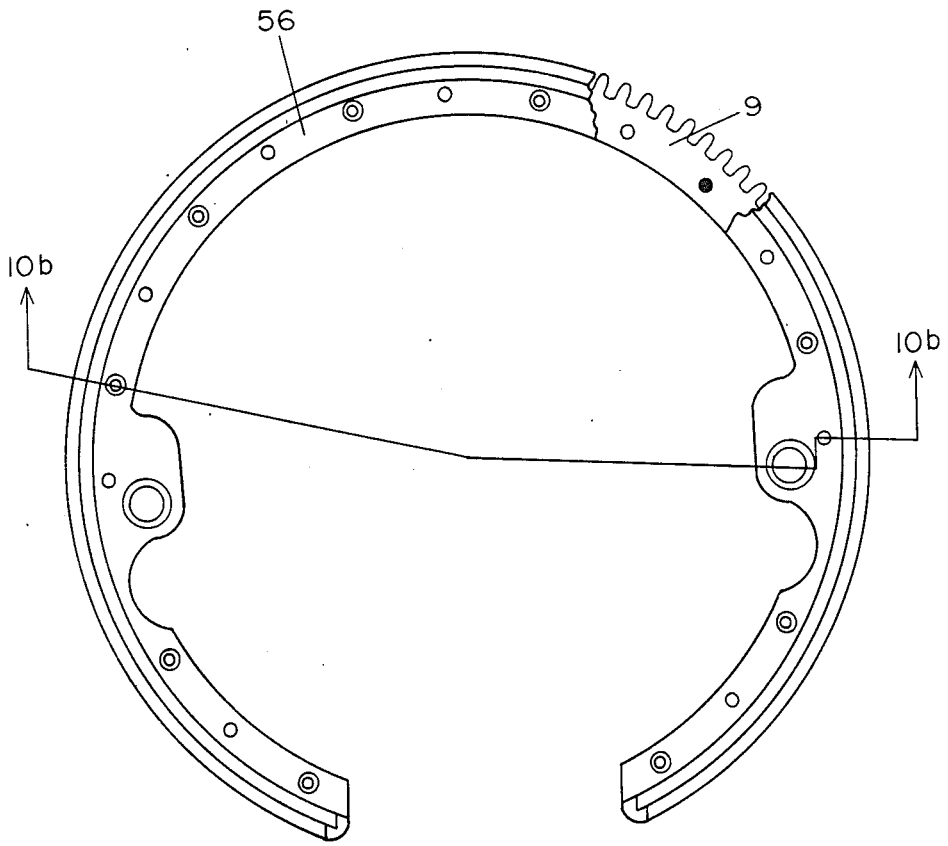
FIG. 10*a* is a top plan view of the rotary in FIG. 8, partially cutaway revealing a toothed portion of the rotary.
Figure 10B:
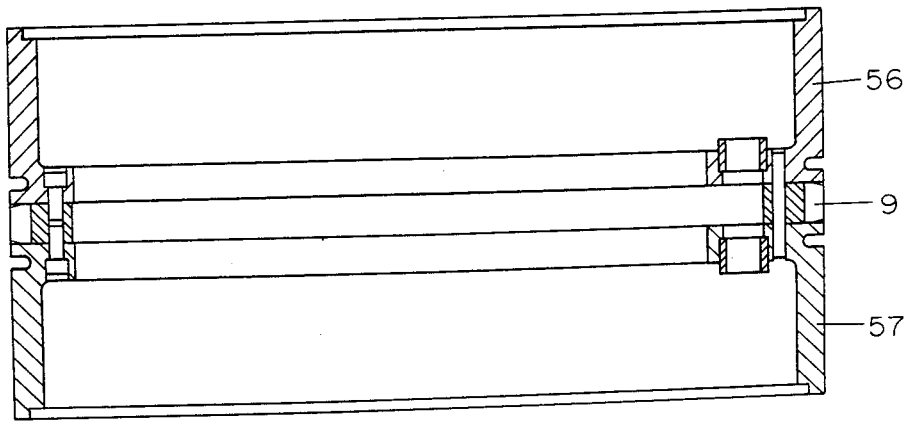
FIG. 10*b* is a side view taken along line 10*b*—10*b* in cross section of the rotary of FIG. 10*a*.

FIGS. 10*a* through 13*b* illustrate various parts of the rotary assembly and the mount brake plates of the apparatus of FIG. 9. FIG. 10*a* is a top view of the rotary parts including the rotary guide 56 and the rotary element 9. FIG. 10*b* shows a side view of the rotary guides 56 and 57 and the rotary element 9.

Figure 11A:
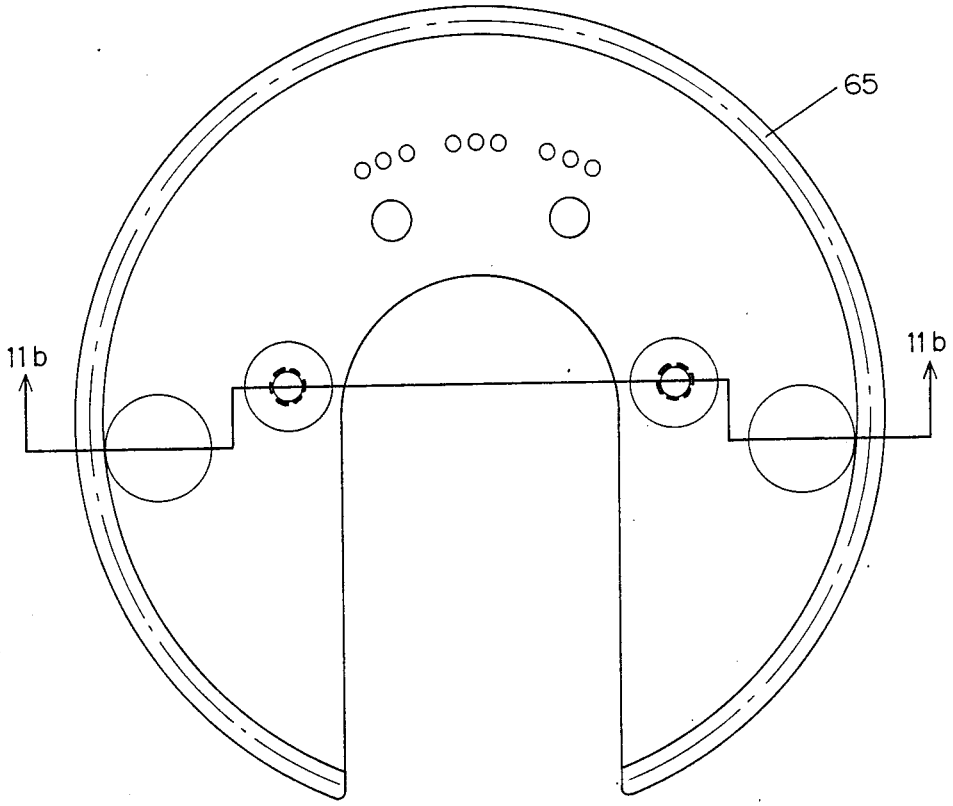
FIG. 11*a* is a top plan view of the mount plate shown in outline in FIG. 9.
Figure 11B:
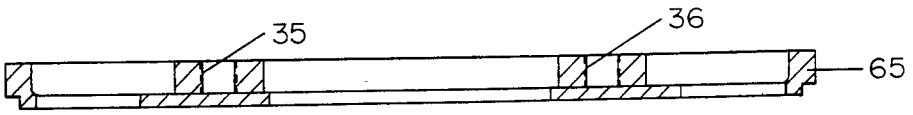
FIG. 11*b* is a side view in cross section along line 11*b*—11*b* of FIG. 11*a* of the mount plate of FIG. 11*a*.

Figs. 11*a* and 11*b* show the mount brake plate 65. Recesses 35 and 36 are for receiving and holding pivot shafts 46 and 47, respectively, of the top backup device 50.

Figure 12A:
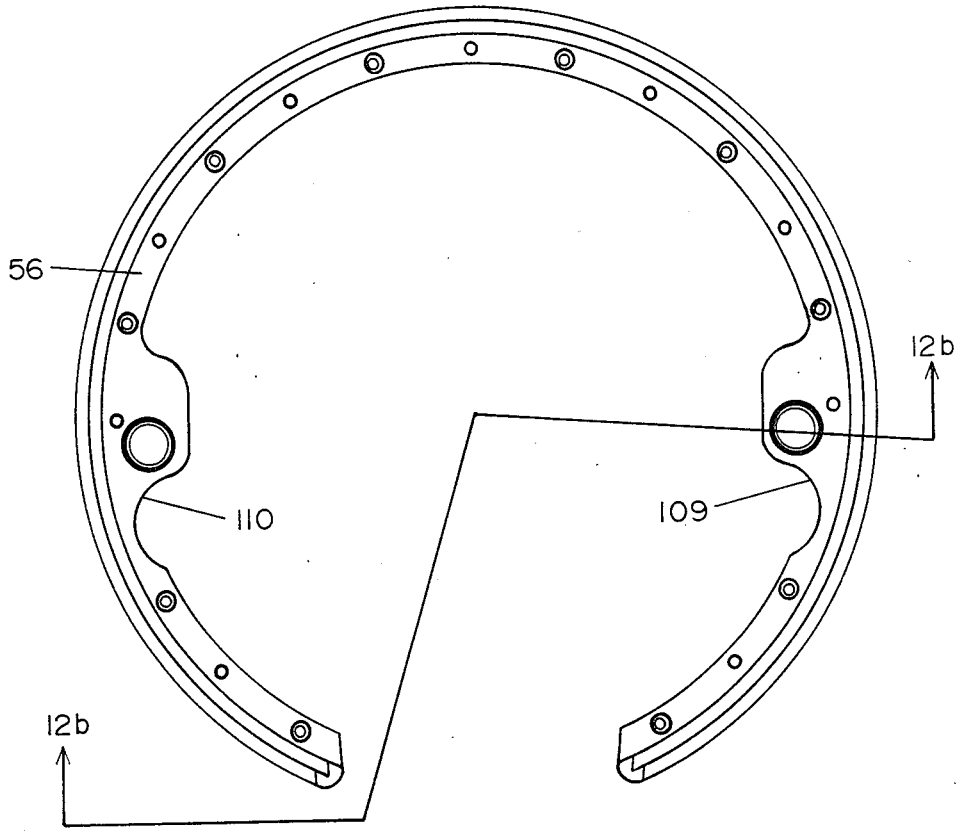
FIG. 12*a* is a top plan view of the rotary guide of FIG. 8.
Figure 12B:
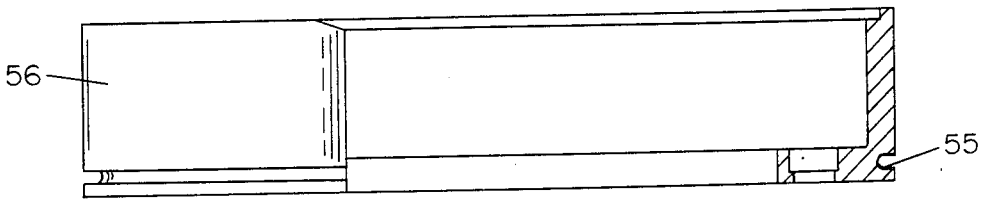
FIG. 12*b* is a side view partially in cross section of the rotary guide of FIG. 12*a* taken along line 12*b*—12*b* of FIG. 12*a*.

FIGS. 12*a* and 12*b* illustrate the top rotary guide 56.

Figure 13A:
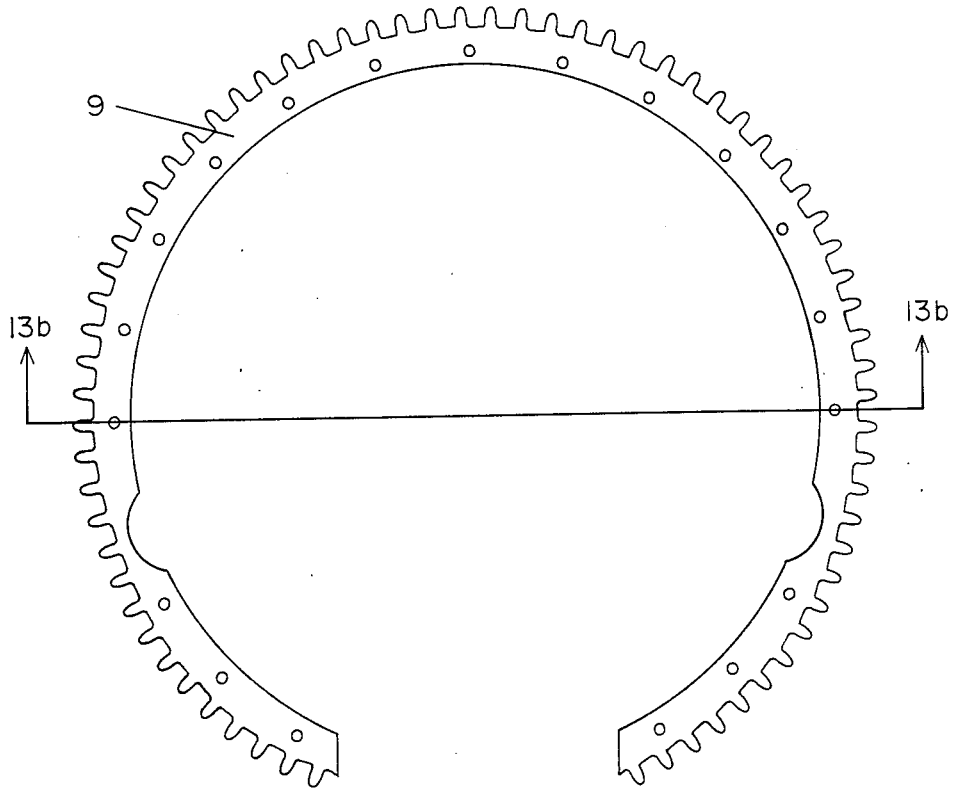
FIG. 13*a* is a top plan view of the rotary element of FIG. 8.
Figure 13B:
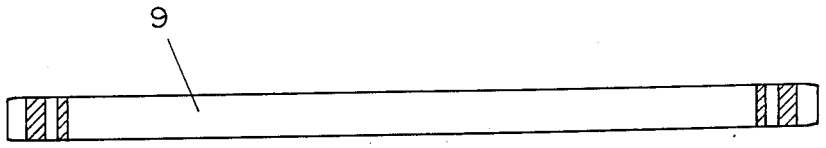
FIG. 13*b* is a side view in cross section of the rotary element of FIG. 13*a* taken along line 13*b*—13*b* of FIG. 13*a*.

FIGS. 13*a* and 13*b* depict the rotary element 9.

Takeup pins 61 are inserted into lugs 33 and 34 by means of slots opening into said lug's center holes. Anchor pins 25 pass in a continuous manner through lugs 33 and 34. To fasten belt 60 to anchor assembly 20, the anchor pins 25 are first pulled out of lugs 33 and 34. The end loops of belt 60 are positioned so as to allow the reinsertion of anchor pins 25 through their center openings as well as lugs 33 and 34. Excess length of belt 60 is taken up by turning lugs 33 and 34. This action causes the takeup pins 61 to capture and wrap belt 60 around the anchor pins 25.

The belt carrier assembly 70 and its parts illustrated in detail in FIGS. 14*a–m* are composed of a tension bar assembly including the tension bar shaft 71, the tension stop members 75 which are secured to the shaft 71, and the tension bar pin 82 secured to the stop members 75; the drive links 74 though which the tension bar shaft 71 is movably mounted and through which the drive pin 69 is also movably mounted for securing the belt carrier assembly to the rotary element 9; the tension stop assembly including the pivot members 76 and the pivot member spacer secured thereto and extending therebetween, the pivot members being movably mounted about the tension bar pin 82; the belt carrier pivot pin 73 which is mounted through the pivot members 76; and the return springs 68 mounted around the tension bar shaft 71 and extending to contact the drive pin 69 and the belt carrier pivot pin 73.

Figure 15A:
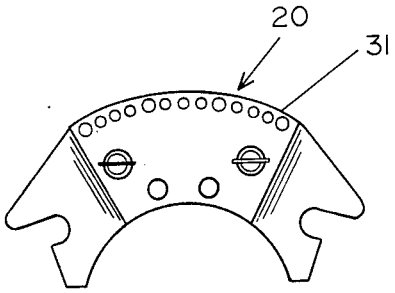
FIG. 15*a* is a top view of the anchor assembly shown in FIG. 9.
Figure 15B:
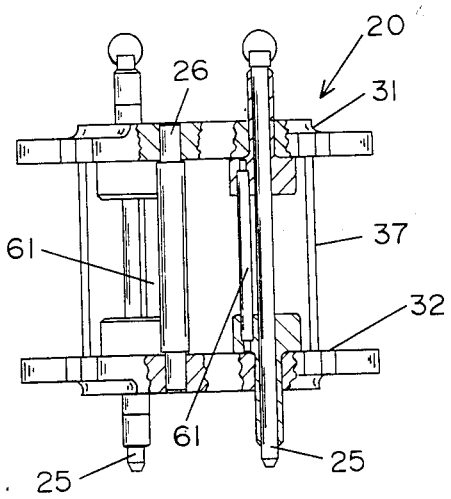
FIG. 15*b* is a side view of the anchor assembly of FIG. 15*a*, partially in cross section.
Figure 15C:
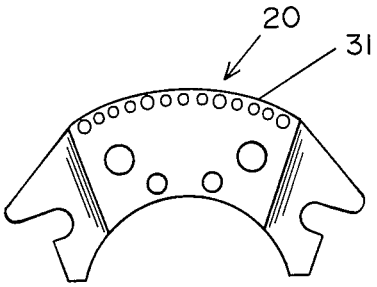
FIG. 15*c* is a top view of the anchor plate of FIG. 15*a*.
Figure 15D:
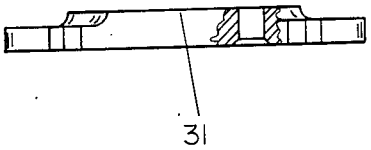
FIG. 15*d* is a side view, partially in cross section, of the anchor plate of FIG. 15*c*.
Figure 15E:
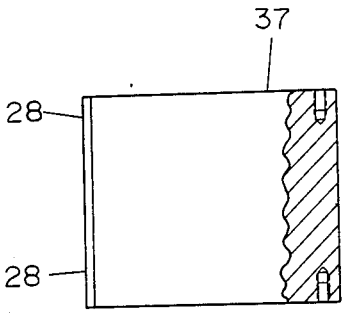
FIG. 15*e* is a side view of the anchor assembly spacer shown in FIG. 15*b* and FIG. 15*f* is a top view of the anchor assembly spacer of FIG. 15*e*.

The anchor assembly 20 is shown in FIGS. 15*a–f*. The anchor assembly top plate 31 is connected to the anchor assembly bottom plate 32 by the anchor assembly spacer back plate 37 which is secured to each plate. The holes indicated in FIG. 15*c* are for the following:

E1, E2—openings for screws to fasten top plate 31 to spacer back plate.

F1, F2, F3—threaded holes to fasten mount brake plate 65 to top plate 31.

G1, G2—locating holes to position mount brake plate 65 to top plate 31.

C1—clearance hole for locating lug 33.

Figure 15F:
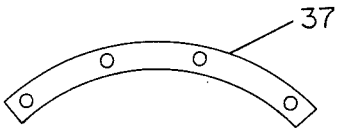

B1—clearance hole for locating guide pin 26. FIG. 15*b* illustrates the anchor assembly 20, anchor pins 25, and take up pins 61. The top plate 31 is shown in FIG. 15*d* which illustrates in cutaway the lug 33 clearance hole. The anchor assembly back plate 37 is illustrated in FIG. 15*f* (top view) and FIG. 15*e* (side view, partially cutaway showing holes for receiving bolts for securing the plates 31 and 32).

Figure 16:
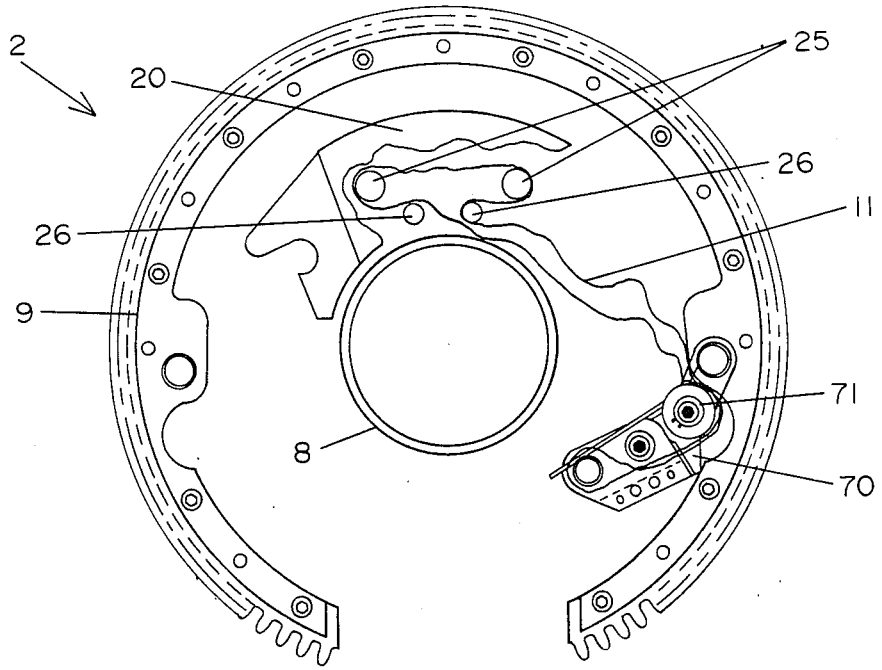
FIG. 16 is a top plan view of a tong rotary and belt apparatus according to the present invention with an endless belt.

As shown in FIG. 16, an endless belt 11 can be employed with the tong 2. The belt 11 is looped around the anchor pins 25, extends between the guide pins 26, wraps around the tension bar shaft 71, and is looped around the belt carrier pivot pin 73. From the side, the belt is seen as wrapped around and between anchor pins 25 and take up pins 61 and then passing between the guide pins 26, wrapping around the pipe 8, passing between the drive pin 60 and the tension bar shaft 71, passing around the tension bar pin 72 and looping around belt carrier pivot pin 73. The belt is in a plane between lugs 33 and 34. Unlike rotative apparatuses which employ endless chains or belts which are disposed symmetrically about the tubular to be rotated and within the apparatus itself, the endless belt (or non-endless belt) used with tong 8 is not symmetrically disposed either with respect to the tong or with respect to the pipe 8.

Figure 17A:
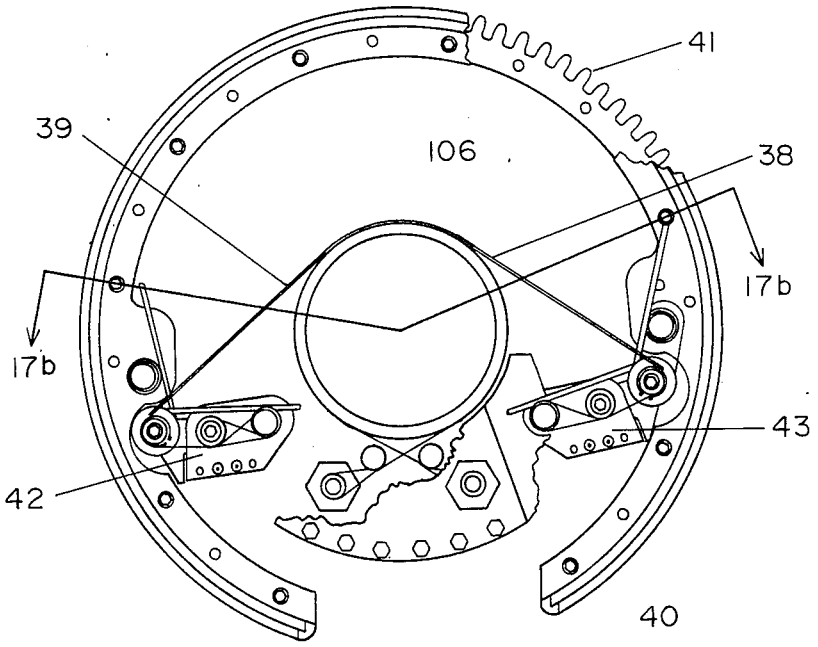
FIG. 17*a* is a top plan view of a tong rotary, belt apparatus, and backup device according to the present invention showing dual belt assemblies and dual belts.
Figure 17B:
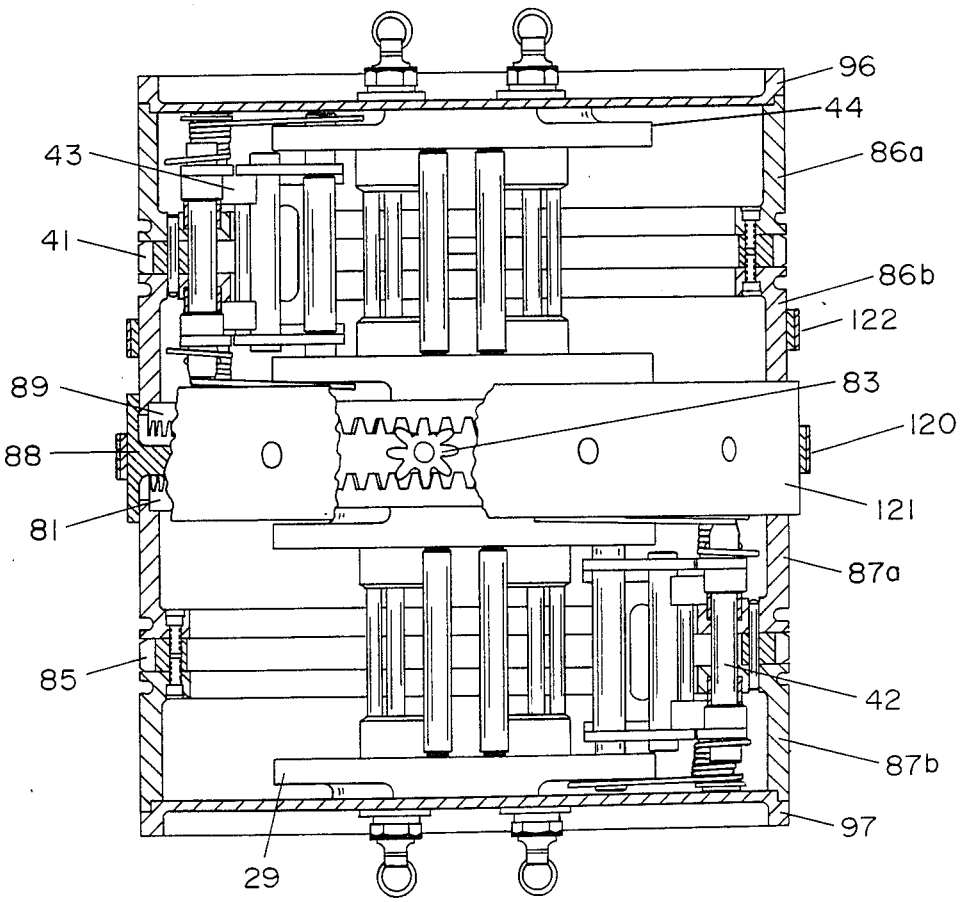
FIG. 17*b* is a side view partially in cross section taken along line 17*b*—17*b* of FIG. 17*a* of the double rotary and belt apparatus shown in FIG. 17*a*.

FIGS. 17*a* and 17*b* show a tong 40 with dual rotaries 41 and 85 and dual belt carrier assemblies 42 and 43 (each corresponding to the belt carrier assembly 70 of the tong 2). Belt carrier assembly 43 is associated with non-endless belt 38 and belt carrier assembly 42 is associated with a non-endless belt 39. By wrapping and energizing the belts 38 and 39 in opposite directions before rotating the pipe 106, it is possible to centrally locate said pipe and balance the forces applied.

The rotary element 41 is connected to the top rotary guide 86*a* and to the bottom rotary guide 86*b*. The bottom rotary element 85 is connected to its top rotary guide 87*a* and its bottom rotary guide 87*b*. The top rotary guide 86*a* is movable with respect to the top mount plate 96 and the bottom rotary guide 87*b* is movable with respect to the bottom mount brake plate 97.

Geared mount plates 81 and 89 correspond to mount plates 65 and 64 respectively of the tong 2. However, the geared mount plates 81 and 89 do not have braking capabilities. In practice, only one rotary element (such as rotary element 85) is driven, not both. Brake apparatus 120 restrains gear holder 121 from initially turning when rotary element 85 is rotated. Brake apparatus 122 restrains top rotary guides 86*a* and 86*b* and rotary element 41 from turning by virtue of these items being fastened together. Gear mount plate 81 transmits motion to arcuately distributed gears 83 located on the gear holder 121. This in turn drives, in the opposite direction, geared mount plate 89. Geared mount plate 89 drives top anchor assembly 44 causing engagement and energizing of belt 38 on belt carrier assembly 43. Energizing of belt 38 causes top rotary guides 86*a* and 86*b* rotary element 41, gear holder 121 and gears 83 to turn with lower rotary element 85 and its associated parts by overcoming braking friction supplied by brake apparatus 120 and 122. When this occurs, gear mount plate 89 and top anchor assembly 44 reverse their direction and turn with rotary element 41 and its associated parts.

A top anchor assembly 44 and a bottom anchor assembly 29 correspond to the anchor assembly 20 of the tong 2.

The belt employed in the present invention, since it can be preloaded in such a way that it is wrapped around a tubular in an energized fashion thereby behaving as a band brake, can produce a reactionary force which tends to pull the tubular off-center. To maintain the center line of the tubular on the center line of the rotary element, this reactionary force should be resisted, counteracted, or balanced. An off-center tubular will travel in an eccentric, rather than circular, path and accurate torque measurements become difficult or impossible. FIGS. 8, 9, and 19 include backup devices to counteract the unwanted reactionary force.

Each backup device 50 and 51 is attached to a mount brake plate and has two arms mounted one above the other. The arms are movable in and out perpendicular to the axis of the tubular to be rotated and can accommodate a wide range of tubular diameters within the constraints of a tong's size.

Figure 19A:
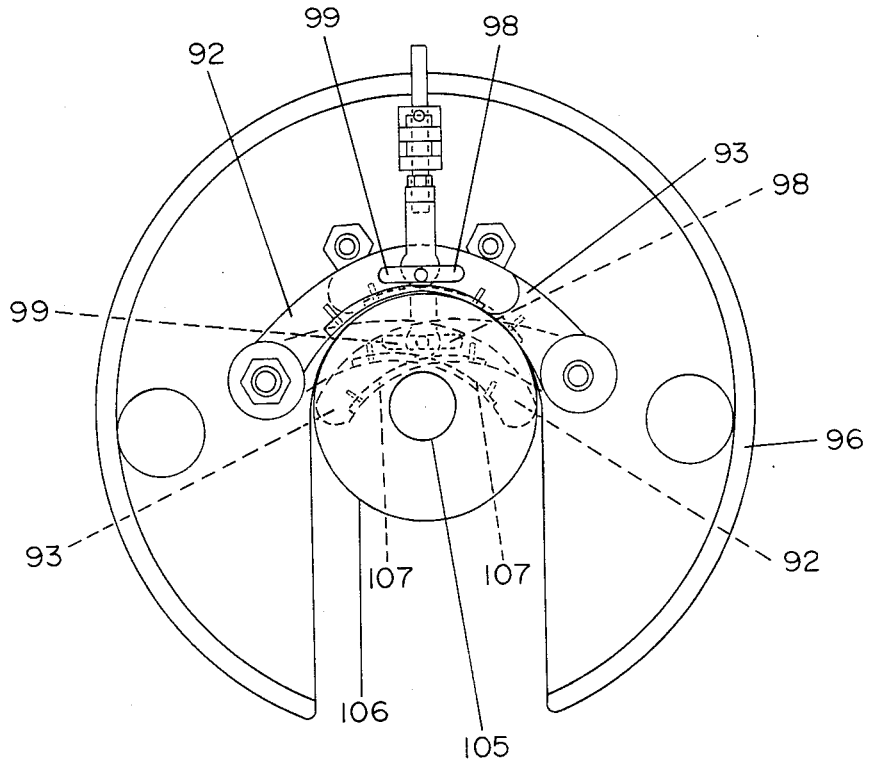
FIG. 19*a* is a top plan view of the backup device of FIG. 17*a*.
Figure 19B:
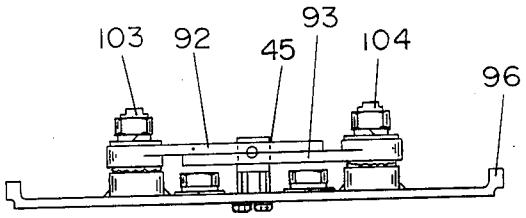
FIG. 19*b* is a front view of the backup device of FIG. 19*a*.
Figure 19C:
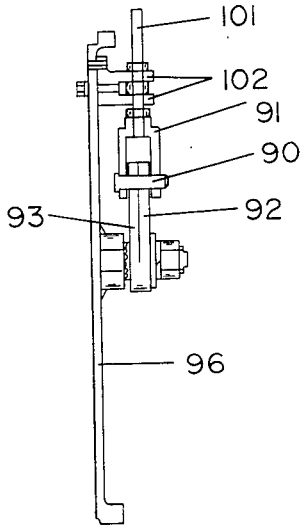
FIG. 19*c* is a side view of the backup device of FIG. 19*a*.
Figure 20:
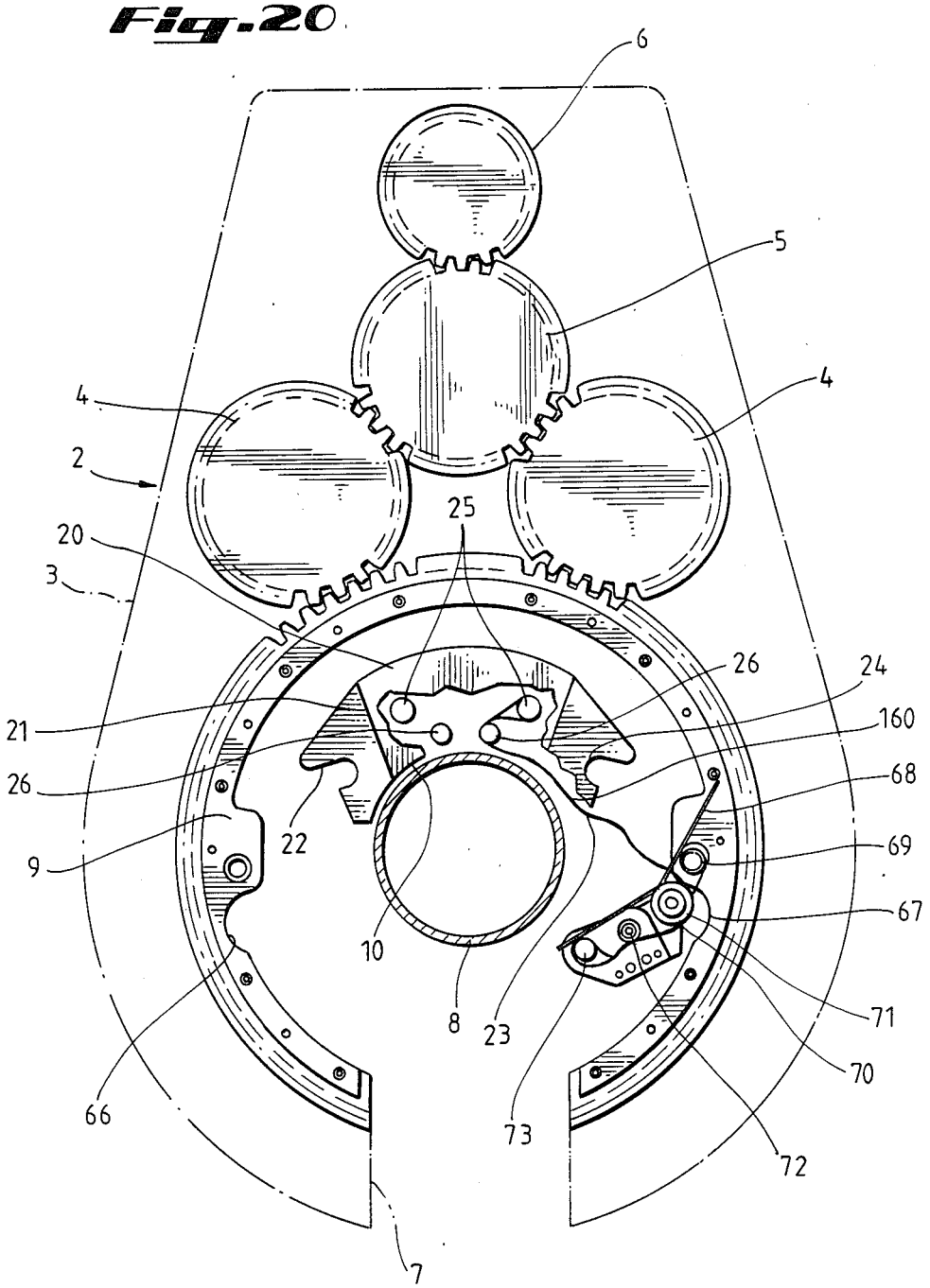
FIG. 20 is a top plan view of a tong according to the present invention with a non-endless belt.

The backup device 45 shown in FIGS. 19*a*, 19*b*, and 19*c* has a rod 101 movably mounted in mounts 102 and connected to a yoke 91. A pin 90 extends through the yoke 91 and through top arm 92 and bottom arm 93. The arms are movable about the pin 90. The arms 92, 93 are pivotably mounted to the brake plate 96 on shafts 103, 104, respectively. Movement of the rod 101 toward the center of the tong will cause the arms to pivot inwardly as the pin 90 moves in a recess 98 of the arm 92 and a recess 99 of the arm 93. As shown in FIG. 19*a*, when pipe 105 of smaller size than pipe 106 is to be rotated, the arms move inwardly to contact the smaller pipe and maintain it in a centered position. A non-metallic high friction material can be employed for the contact surfaces 107 on the arms.

Figure 18:
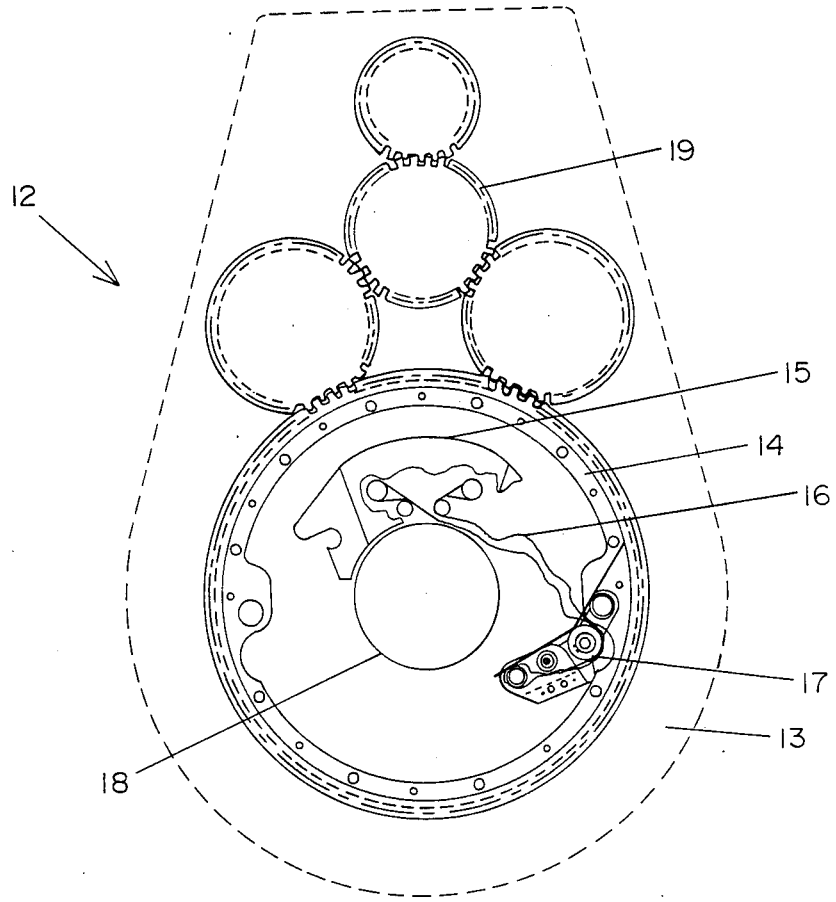
FIG. 18 shows a closed-housing tong and belt apparatus according to the present invention.

The tong 12 of FIG. 18 has the closed housing 13, closed rotary element 18, the anchor assembly 15 (corresponding to the anchor assembly 20), the belt 16 (corresponding to the belt 60), the belt carrier assembly 17 (corresponding to the belt carrier assembly 70), and the drive train 19 for rotating the tubular 18.

In operation of the tong 2, pivot pin 73 on the belt carrier 70 contacts the finger 27 on the plate 21 and is stopped by the wall of the recess 22. After this occurs, the recess will only allow rotation of the pivot pin 73, not axial movement, thus trapping it. The rotary element 9 is still turning at this time and therefore driving the belt carrier 70. The belt carrier 70 itself is biased to hinge or toggle in one direction only with appropriate return springs 68 used to keep the device in an open position.

As the rotary element 9 drives the belt carrier 70, sufficient force is exerted against the springs 68 to allow the belt carrier pivot member 76 to toggle or hinge about the tension bar pin 72. This shortens the distance between the tension bar shaft 71 and belt carrier pivot pin 73. However, it may be necessary to provide a recess pocket or cutout (such as the rotary recess 67) in the rotary element and rotary guide (such as recesses 109, 110 FIG. 12*a*) to prevent interference with the tension bar shaft 71 as the belt carrier toggles or hinges. This is dependent on the tong's tubular diameter capacity and is not required in all cases. The length of the belt on the belt carrier is also shortened because it is wrapped around the aforementioned components as they move. Though this creates a slack condition in the belt, it is automatically taken up by the continued rotation of the rotary element and belt carrier and the still stationary anchor pins 25. The belt carrier 70 continues to be driven by the rotary element 9 and causes the belt carrier pivot member 76 to rotate about the now trapped pivot pin 73, coming to rest against the anchor assembly spacer 37. At this point the tension bar shaft 71 and tension bar pin 72 continue to move or rotate in relation to the belt carrier pivot member 76. This lengthens the distance between the tension bar shaft 71 and the belt carrier pivot pin 73. As this occurs, the belt is pulled or preloaded by the movement of the tension bar shaft 71. This preload is large because of the geometric relationship of the components involved imparting a force multiplication on the belt. This continues until the tension bar stop member 75 on the tension bar shaft 71 contacts the pivot member 76. At this time, the belt has sufficient frictional contact with the pipe to turn it with the rotary.

As has been shown and described the preferred embodiments have included two embodiments of the belt. In the device of FIG. 1, the belt 60 has two ends and an intermediate loop. The two ends are each secured to different anchor pins 25 on the anchor assembly 20 and the intermediate loop extends to the belt carrier assembly 70 and is looped around the belt carrier pivot pin 73. The belt 11 as shown in FIG. 16 is an endless loop which is looped around the anchor pins 25 on the anchor assembly and around the belt carrier assembly 70. As noted above in the summary of this invention, the belt can be a belt with two ends, one secured to the anchor assembly and one secured to the belt carrier. In one form of this two-ended belt there is no intermediate portion looped around the belt carrier.

In conclusion, therefore, it is seen that the present invention and the embodiments disclosed herein are well adapted to carry out the objectives and obtain the ends set forth as well as others inherent therein. To one of skill in this art who has the benefit of this invention's teachings, it will be clear that certain changes can be made in the apparatus and parts thereof without departing from the spirit and scope of the invention as claimed.

What is claimed is:

1. A belt assembly in a tong, the tong suitable for rotating a tubular member, the tong having a housing with an opening therein for receiving the tubular member and a rotary assembly rotatably mounted within the housing, the rotary assembly rotatable in combination with the belt assembly for rotating the tubular member, the tong having brake plates disposed on the rotary assembly and braking means for acting on the brake plate means to provide braking action on the brake plates, the belt assembly comprising an anchor member secured to the brake plates, the anchor member having an anchor member recess, a belt carrier pivotably mounted to the rotary assembly and having a belt carrier pivot pin receivable in the anchor member recess, a belt made of flexible material mounted about the anchor member and extending to and mounted about the belt carrier, and the rotary assembly rotable around the tubular member to bring the belt carrier pivot pin into the anchor member recess and to wrap the belt around a portion of the tubular member, the rotary assembly rotatable with the anchor member, the brake plates, and the belt assembly to rotate the tubular member.

2. The belt assembly of claim 1 wherein the belt has a first end secured to the anchor member and a second end secured to the belt carrier.

3. The belt assembly of claim 1 wherein the belt has a first end secured to the anchor member, an intermediate portion looped around the belt carrier, and a second end secured to the anchor member.

4. The belt assembly of claim 1 wherein the belt is endless and is looped around the anchor member and around the belt carrier.

5. The belt assembly of claim 1 including also guide means secured to the anchor member for positioning the belt and for increasing the extent of the belt contacting the tubular member.

6. The belt assembly of claim 1 wherein the belt carrier's pivotable mounting to the rotary assembly provides leveraged tightening of the belt about the tubular member.

7. The belt assembly of claim 1 wherein the brake means is able to hold the brake plates and anchor member immobile until the rotary assembly is moved with sufficient force to overcome the braking force of the brake means.

8. The belt assembly of claim 1 wherein the flexible belt is made from woven nylon or aramid material.

9. The belt assembly of claim 1 including also a backup device connected to the housing for maintaining the tubular member in a centered position in the tong opening.

10. Tong apparatus for rotating a tubular member, said tong apparatus including, a tong housing, an opening in the tong housing for receiving the tubular member to be rotated, a rotary assembly rotatably mounted within the housing, brake plates disposed on the rotary assembly and braking means for acting on the brake plates to provide braking action on the brake plates, an anchor member secured to the brake plate means, the anchor member having an anchor member recess, a belt assembly comprising, a belt carrier pivotably mounted to the rotary assembly and having a belt carrier pivot pin receivable in the anchor member recess, a belt made of flexible material for wrapping around the tubular member, said belt mounted about the anchor member and extending to and mounted about the belt carrier, the rotary assembly with the belt carrier rotatable around the tubular member to bring the belt carrier pivot pin into the anchor member recess and to wrap the belt around a portion of the tubular member, the rotary assembly rotatable with the anchor member, the brake plates, and the belt assembly to rotate the tubular member.

11. The tong apparatus of claim 10 wherein the belt has a first end secured to the anchor member and a second end secured to the belt carrier.

12. The tong apparatus of claim 10 wherein the belt has a first end secured to the anchor member, an intermediate portion looped around the belt carrier, and a second end secured to the anchor member.

13. The tong apparatus of claim 10 wherein the belt is endless and is looped around the anchor member and around the belt carrier.

14. The tong apparatus of claim 10 wherein the belt assembly includes guide means secured to the anchor member for positioning the belt and for increasing the extent of the belt contacting the tubular member.

15. The tong apparatus of claim 10 wherein the belt carrier's pivotable mounting to the rotary assembly provides leveraged tightening of the belt about the tubular member.

16. The tong apparatus of claim 10 wherein the opening extends through the side of the housing so that the tong apparatus is emplaceable about a tubular member without requiring that it first receive an end of the tubular member.

17. The tong apparatus of claim 10 including also a backup device connected to the housing for maintaining the position of the tubular member to be rotated during operation of the tong apparatus.

* * * * *